US010836058B2

(12) United States Patent
Omori et al.

(10) Patent No.: US 10,836,058 B2
(45) Date of Patent: Nov. 17, 2020

(54) METHOD OF PRODUCING AN OUTER BLADE FOR A HAIR CUTTING DEVICE

(71) Applicant: PANASONIC INTELLECTUAL PROPERTY MANAGEMENT CO., LTD., Osaka (JP)

(72) Inventors: Masato Omori, Shiga (JP); Katsuhiro Higuchi, Shiga (JP); Hiroyuki Naoe, Shiga (JP); Koji Yamada, Shiga (JP); Hiroaki Shimizu, Shiga (JP); Shoki Okura, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 58 days.

(21) Appl. No.: 15/889,874

(22) Filed: Feb. 6, 2018

(65) Prior Publication Data

US 2018/0243930 A1 Aug. 30, 2018

(30) Foreign Application Priority Data

Feb. 24, 2017 (JP) ..... 2017-034144

(51) Int. Cl.

| | |
|---|---|
| ***B26B 19/38*** | (2006.01) |
| ***B26B 19/42*** | (2006.01) |
| ***B26B 19/14*** | (2006.01) |

(52) U.S. Cl.

CPC ..... *B26B 19/3893* (2013.01); *B26B 19/143* (2013.01); *B26B 19/384* (2013.01); *B26B 19/3846* (2013.01); *B26B 19/42* (2013.01)

(58) Field of Classification Search

CPC ..... B26B 19/384; B26B 19/3893; B26B 19/3846; B26B 19/02; B26B 19/12

(Continued)

(56) References Cited

U.S. PATENT DOCUMENTS 2,255,894 A * 9/1941 Ormond ..... B26B 19/384 30/43.92

2,266,885 A 12/1941 Martin (Continued)

FOREIGN PATENT DOCUMENTS

EP 3257640 A1 12/2017

EP 3366436 A1 * 8/2018 ..... B26B 19/384

(Continued)

OTHER PUBLICATIONS

The Extended European Search Report dated Jul. 12, 2018 for the related European Patent Application No. 18156129.1.

*Primary Examiner* — Jason Daniel Prone

(74) *Attorney, Agent, or Firm* — McDermott Will & Emery LLP

(57) ABSTRACT

Provided is a method of producing an outer blade for a hair cutting device from a material including bars that each have a shape of a rectangular stick and are arranged at predetermined intervals. The material is placed on a base. Next, a first tool having a leading end that has a gradually increasing width in a direction away from the material is used to press at least one part of each of the bars in a direction from a counter base-side first face of each of the bars toward a base-side second face of each of the bars. An edge of the first face of each of the bars is caused to project widthwise and to move toward the second face to be farther from an intermediate part of the first face.

7 Claims, 10 Drawing Sheets

(58) Field of Classification Search
USPC ..... 76/101.1, 104.1, DIG. 8; 30/43.7–43.92
See application file for complete search history.

(56) References Cited

U.S. PATENT DOCUMENTS

| | | | | | |
|---|---|---|---|---|---|
| 3,216,286 | A * | 11/1965 | Heyek | B26B 19/384 | 76/116 |
| 3,634,936 | A * | 1/1972 | Battigalli | B26B 19/384 | 30/43.92 |
| 3,714,807 | A * | 2/1973 | Grunberger | B26B 19/384 | 76/104.1 |
| 3,881,373 | A * | 5/1975 | Nakamura | B26B 19/384 | 76/104.1 |
| 4,138,811 | A | 2/1979 | Chauvy | | |
| 4,493,149 | A * | 1/1985 | Tanahashi | B26B 19/384 | 30/43.92 |
| 5,901,446 | A * | 5/1999 | Szymansky | B26B 19/384 | 30/43.92 |
| 5,983,756 | A * | 11/1999 | Orloff | B26B 19/384 | 76/104.1 |
| 7,730,621 | B2 * | 6/2010 | Komori | B26B 19/384 | 30/43.92 |
| 8,104,181 | B2 * | 1/2012 | Kawaguchi | B26B 19/384 | 30/43.92 |
| 8,925,205 | B2 * | 1/2015 | Iwasaki | B26B 19/384 | 30/34.2 |
| 9,108,325 | B2 * | 8/2015 | Sakon | B26B 19/384 | |
| 9,186,803 | B2 * | 11/2015 | Higuchi | B26B 19/384 | |
| 9,248,578 | B2 * | 2/2016 | Kobayashi | B26B 19/384 | |
| 2004/0187644 | A1 * | 9/2004 | Peterlin | B26B 21/28 | 76/104.1 |
| 2007/0157762 | A1 * | 7/2007 | Frechette | B26B 19/384 | 76/104.1 |
| 2008/0276460 | A1 * | 11/2008 | Yanosaka | B26B 19/044 | 76/104.1 |
| 2013/0000126 | A1 | 1/2013 | Higuchi et al. | | |
| 2014/0311306 | A1 * | 10/2014 | Sablatschan | B26B 19/3846 | 76/104.1 |
| 2018/0243931 | A1 * | 8/2018 | Okura | B26B 19/3846 | |

FOREIGN PATENT DOCUMENTS

| | | | | |
|---|---|---|---|---|
| JP | 2011-200492 | A | 10/2011 | |
| JP | 2018138157 | A * | 9/2018 | B26B 19/3846 |
| JP | 2018139629 | A * | 9/2018 | B26B 19/3893 |

* cited by examiner

METHOD OF PRODUCING AN OUTER BLADE FOR A HAIR CUTTING DEVICE

BACKGROUND

1. Technical Field

The present disclosure relates to a method of producing an outer blade for a hair cutting device such as an electric shaver, an outer blade for a hair cutting device, and a hair cutting device including an outer blade for a hair cutting device.

2. Description of the Related Art

As shown in Unexamined Japanese Patent Publication No. 2011-200492, a conventional method of producing an outer blade for a hair cutting device may include, for example, a process of forming bars of comb-teeth shape by making slit-shaped blade holes in a material that is a metal sheet and a process of forming hair raising parts that raise hair lying flat with respect to the bars. The bars defining the blade hole are bent at a peripheral edge of the blade hole toward an inner blade side to have roundness, thereby forming the hair raising parts. With the roundness, flat-lying hair can be raised effectively while skin irritation is suppressed.

SUMMARY

The conventional formation of the hair raising parts by bending at the peripheral edge of the blade hole, however, has such a problem that the material for the outer blade is limited to a thin plate that is susceptible of bending. Moreover, the hair raising part of the outer blade becomes substantially twice as thick as the material, and because the part that first comes into contact with hair is rounded, there are cases where hair in close contact with a skin surface is difficult to raise.

The present disclosure provides a method of producing an outer blade that is used in a hair cutting device, the outer blade that has an enhanced hair raising effect and reduces skin irritation, and also provides an outer blade for a hair cutting device, and a hair cutting device.

A method of producing the outer blade for the hair cutting device included in the present disclosure is a method of producing an outer blade for a hair cutting device from a material including bars that each have a shape of a rectangular stick and are arranged at predetermined intervals. In this method, the material is placed on a base, and a first tool that is used includes a leading end having a gradually increasing width in a direction away from the material. Next, at least one part of each of the bars is pressed in a direction from a counter base-side first face of each of the bars toward a base-side second face of each of the bars. An edge of the first face of each of the bars is caused to project widthwise and to move toward the second face to be farther from an intermediate part of the first face.

The outer blade for the hair cutting device also included in the present disclosure includes bars that each have a shape of a rectangular stick and are arranged at predetermined intervals. This outer blade also includes a slope that gradually slopes toward an inner-blade-side second face of each of the bars, heading outward from an intermediate part of a skin-contact-side first face of each of the bars along a width of the first face, and an edge of the slope. This edge projects outwardly of the second face.

The hair cutting device also included in the present disclosure includes the outer blade for the hair cutting device including bars that each have a shape of a rectangular stick and are arranged at predetermined intervals. The outer blade for the hair cutting device also includes a slope that gradually slopes toward an inner-blade-side second face of each of the bars, heading outward from an intermediate part of a skin-contact-side first face of each of the bars along a width of the first face, and an edge of the slope. This edge projects outwardly of the second face.

It is to be noted that also included in practice of the present disclosure is execution of a program that causes a computer to execute processes included in the production method. Naturally, also use of a recording medium on which the program is recorded is included in the practice of the present disclosure.

A method of producing the outer blade for the hair cutting device of the present disclosure can provide an outer blade of a shape that has an enhanced hair raising effect and that can suppress skin irritation.

DETAILED DESCRIPTION

Exemplary Embodiments

With reference to the drawings, a description is provided of exemplary embodiments of a method of producing an outer blade for a hair cutting device, an outer blade for a hair cutting device, and a hair cutting device according to the present disclosure. It is to be noted that the following exemplary embodiments merely exemplify the method of producing the outer blade for the hair cutting device, the outer blade for the hair cutting device, and the hair cutting device of the present disclosure. Therefore, the scope of the present disclosure is defined by the recitation in the claims with reference to the following exemplary embodiments, and the present disclosure is not limited only to the following exemplary embodiments. Thus, among constituent elements in the following exemplary embodiments, constituent elements not recited in any one of the independent claims that indicate the most generic concepts of the present disclosure are not necessarily essential for achievement of the object of the present disclosure but are described for the preferred embodiments.

The drawings are schematic views in which emphasis, omission, and proportion adjustment are made as required for illustration of the present disclosure and may have shapes, positional relationships, and proportions that differ from actual shapes, actual positional relationships, and actual proportions.

First Exemplary Embodiment

[Material]

Figure 1:
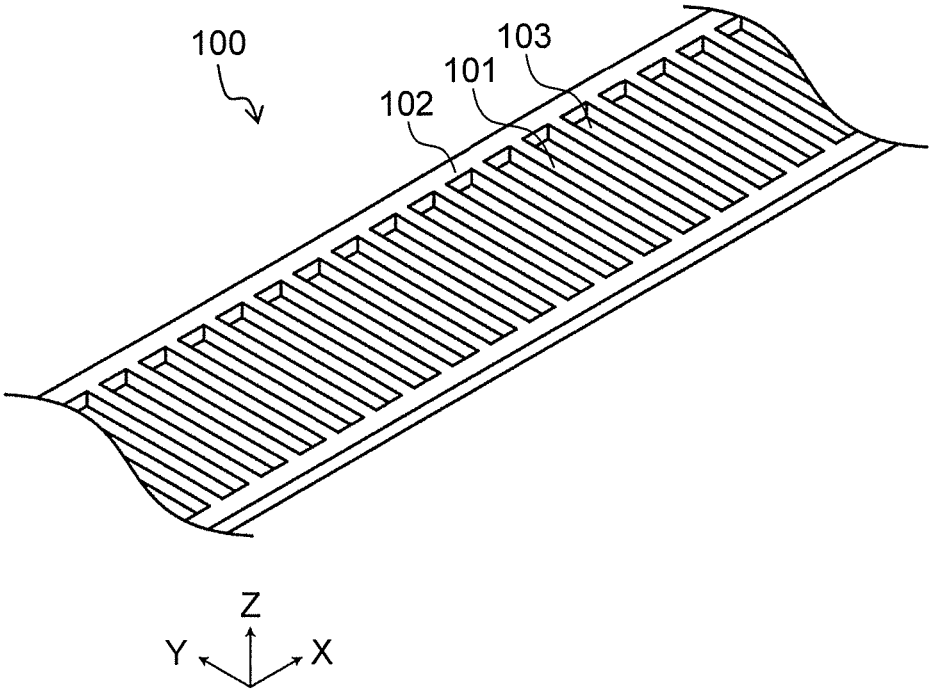
FIG. 1 is a perspective view of a material according to a first exemplary embodiment.

FIG. 1 is a perspective view of material 100.

As shown in the figure, material 100 that becomes an outer blade of a hair cutting device such as an electric shaver is such a member that bars 101 that each have the shape of a rectangular stick and are arranged at predetermined intervals are integrally held by frame 102. Material 100 is provided with blade holes 103 that are each enclosed by bars 101 and frame 102. A method of producing material 100 is not particularly limited. Examples of the method of producing material 100 include stamping from a metal sheet, etching, electroforming, and electrochemical machining.

While a raw material for material 100 is not particularly limited, an example of the raw material can be martensitic stainless steel. Also, a thickness of material 100 is not limited; however, a required thickness is such that material 100 that undergoes machining processes (described below) functions as the outer blade. Specifically, in the case of martensitic stainless steel, for example, the thickness of material 100 needs to be 0.1 mm or more and preferably 0.3 mm or more. From the point of view of shaving a beard, it is preferable that the thickness of material 100 be 0.7 mm or less.

[Base]

Figure 2:
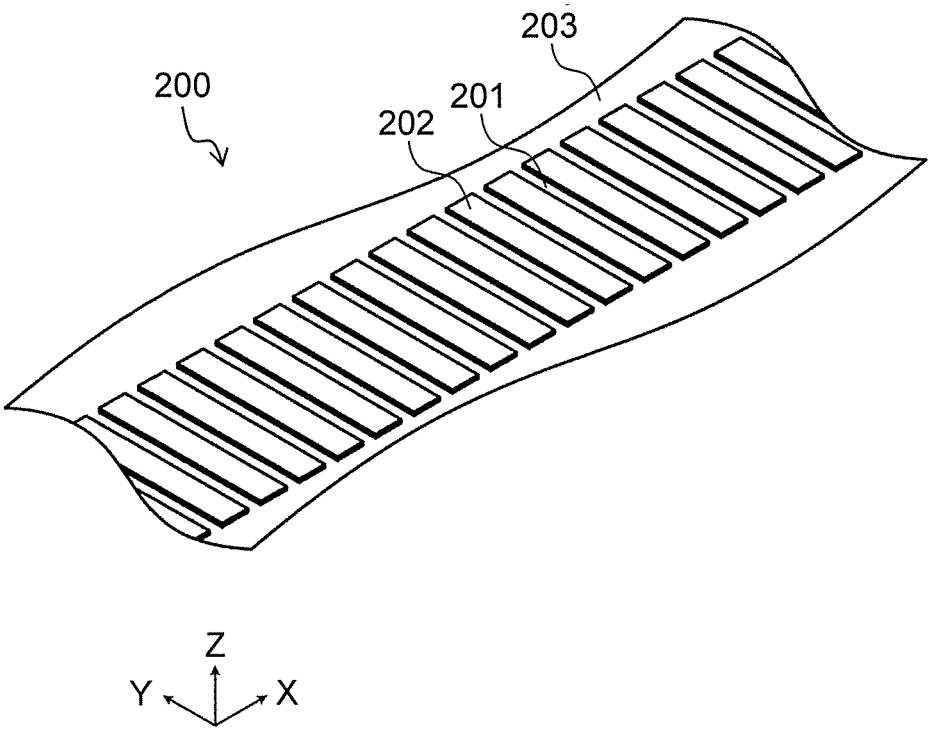
FIG. 2 is a perspective view of a base according to the first exemplary embodiment.

FIG. 2 is a perspective view of base 200.

Base 200 is a jig for holding material 100 that is placed on base 200. Base 200 has a shape that is not particularly limited, and its face on which material 100 is placed may be planar. In the present exemplary embodiment, base 200 includes, to be provided with grooves 201 in which bars 101 of material 100 are respectively fitted, projecting strips 202 that are arranged at equal intervals to project from planar part 203. A height of projecting strips 202 projecting from planar part 203 5% or more and 90% or less of the thickness of material 100.

Figure 3:
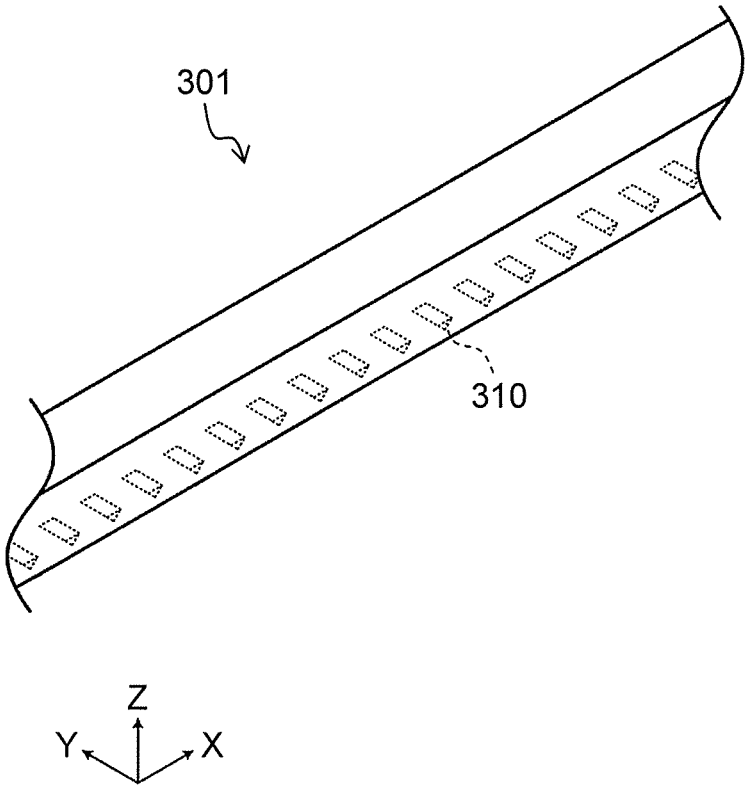
FIG. 3 is a perspective view of a first tool according to the first exemplary embodiment.

FIG. 3 is a perspective view of first tool 301.

Figure 4:
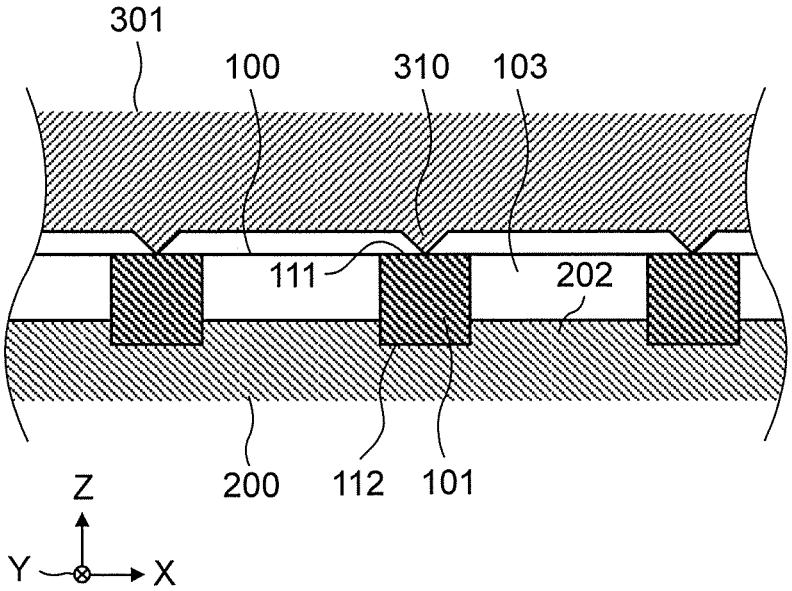
FIG. 4 is a sectional view illustrating the material, the base, and the first tool according to the first exemplary embodiment.

FIG. 4 is a sectional view illustrating material 100, base 200, and first tool 301.

[Tool]

As shown in these figures, first tool 301 is a so-called punch that includes leading ends 310 each having a gradually increasing width (length along an X-axis direction in the figures) in a direction away from material 100. In the present exemplary embodiment, the plurality of leading ends 310 of triangular cross section are integrally held by first tool 301 and are spaced correspondingly to respective bars 101 of material 100 along an arrangement direction of bars 101 (the X-axis direction in the figure), so that the plurality of bars 101 can undergo machining at one time. Each of leading ends 310 is set shorter than bar 101 lengthwise (along a Y-axis direction in the figures). Thus, only a lengthwise part of bar 101 can be plastically deformed. Leading end 310 has cross sections of uniform shape throughout its length in any planes orthogonal to a length of bar 101.

[Producing Method]

A description is provided next of a method of producing an outer blade for a hair cutting device.

[Disposition]

Material 100 is placed on base 200 first. In the present exemplary embodiment, material 100 is disposed on base 200 so that bars 101 of material 100 are respectively fitted in grooves 201 of base 200, that is to say, projecting strips 202 of base 200 are respectively fitted into blade holes 103 that are each positioned between bars 101.

Figure 5:
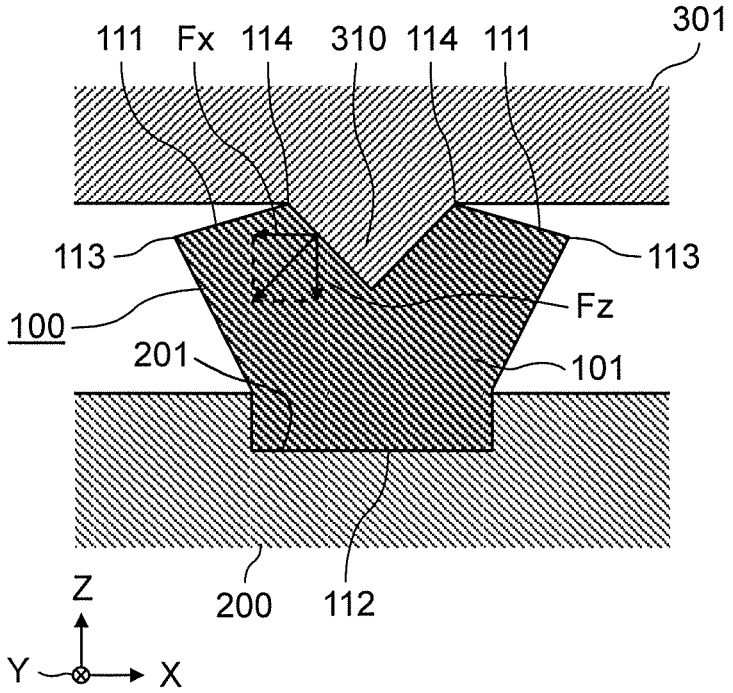
FIG. 5 is a sectional view illustrating a leading end of the first tool pushed into a bar of the material according to the first exemplary embodiment.

FIG. 5 is a sectional view illustrating leading end 310 of first tool 301 pushed into bar 101 of material 100.

[Press 1]

Next, bar 101 is at least partly pressed by leading end 310 of first tool 301 in a direction from counter base-side first face 111 of bar 101 toward base-side second face 112 of bar 101. Specifically, after leading end 310 of first tool 301 comes into contact with bar 101, first tool 301 is pressed toward base 200 by a predetermined amount (length). While the amount of pressing and a pressing speed are of choice, in cases where, for example, material 100 is made of martensitic stainless steel, the amount of pressing is preferably 5% or more and less than 50% of the thickness of material 100. The pressing speed is preferably 5 mm/s or more and 1000 mm/s or less.

Figure 6:
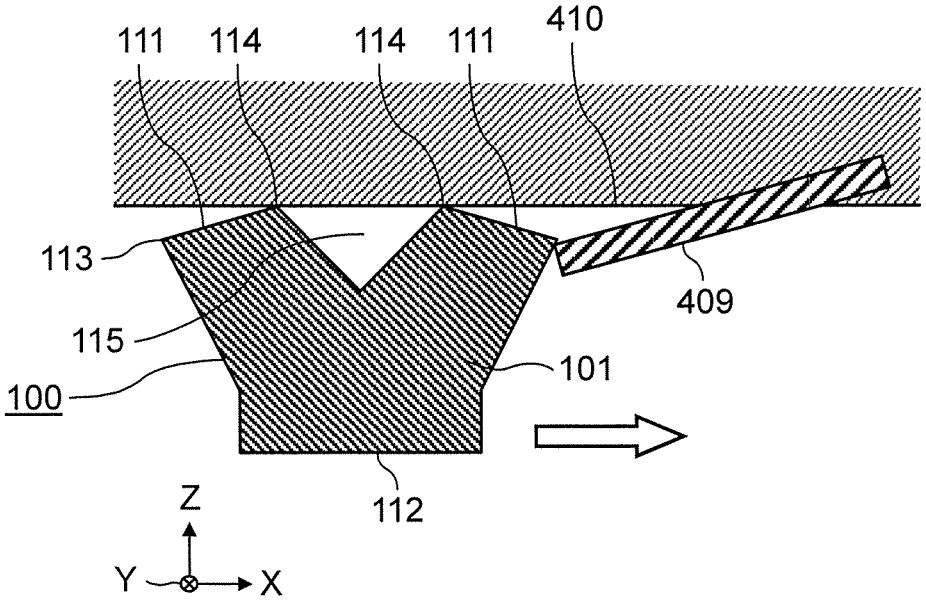
FIG. 6 illustrates an edge raising a hair according to the first exemplary embodiment.

In the above-described manner, force Fx and force Fz are applied to bar 101 in an X-axis direction and a Z-axis direction, respectively. First-tool-end edges 113 of bar 101 are caused by force Fx to bulgingly project widthwise (along the X-axis direction in the figure) through plastic deformation and move toward base 200 to be farther from intermediate part 114 of first face 111 through the plastic deformation. Through this plastic deformation, first face 111 of bar 101 is shaped along a width of bar 101 (along the X-axis direction in the figure) to gently slope toward an inner blade side, heading toward each of its edges 113 with intermediate part 114 projecting most toward a skin surface, so that an outer blade that can thus be formed reduces skin irritation. Because acute edges 113 are each located slightly closer to the inner blade side than the most projecting part of first face 111 is, an enhanced hair raising effect can be exerted even on hair 409 that has grown substantially parallel to skin surface 410 as shown in FIG. 6.

On the other hand, a second-face-side end of bar 101 is pressed by first tool 301 while being fitted in groove 201 of base 200, thus hardly undergoing plastic deformation and keeping its shape. As such, the second-face-side end that cuts hair by passing an inner blade (not shown) keeps its incisive shape and thus can maintain, as an edged tool, its cutting effect.

[Press 2]

In the present exemplary embodiment, the part of bar 101 that has been pressed by first tool 301 is next pressed by second tool 302 having a leading end that differs in shape from leading end 310 of first tool 301.

Figure 7:
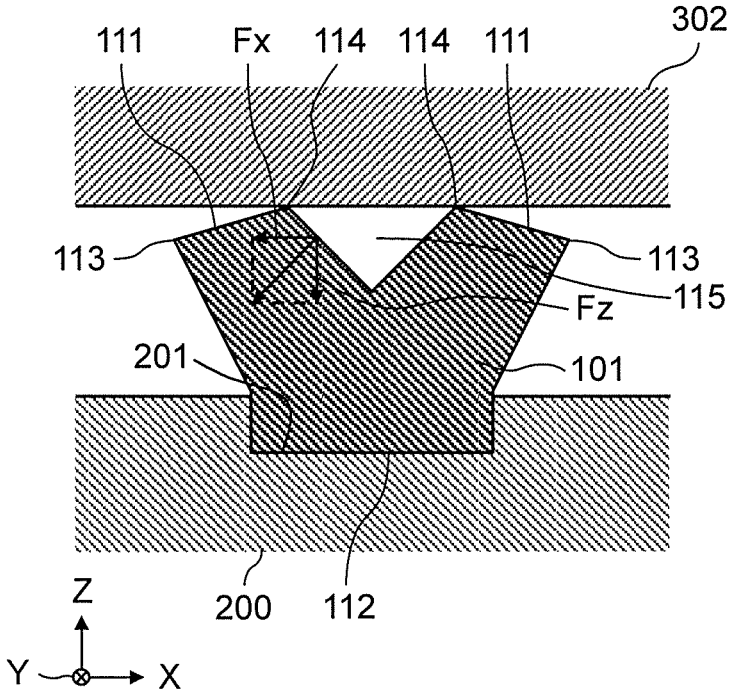
FIG. 7 is a sectional view illustrating a leading end of a second tool being pressed against the bar of the material according to the first exemplary embodiment.

FIG. 7 is a sectional view illustrating the leading end of second tool 302 being pressed against bar 101 of material 100.

In the present exemplary embodiment, the leading end of second tool 302 is flatly shaped for the purpose of rounding off intermediate part 114 of first face 111 after the press given by first tool 301. As described above, second tool 302 presses intermediate part 114 (surrounded opening edge) of first face 111 of bar 101 having recess 115 that is formed as a result of the press given by first tool 301, so that intermediate part 114 that is most pressed against the skin surface can be rounded off and smoothed, and an outer blade that can thus be formed further reduces the skin irritation.

Particularly, in cases where second tool 302 is a plate-shaped tool that has no projecting shapes and thus is even, extending over the plurality of bars 101, respective intermediate parts 114 of bars 101 can have their top faces flattened, so that the plurality of bars 101 are equally pressed against skin. As such, the skin irritation can be reduced.

[Others]

It is to be noted that respective shapes of first tool 301 and second tool 302 are not limited to those described above. Bar 101 may be deformed into a predetermined shape not only by first tool 301 and second tool 302 but also by use of an additional plurality of tools. For example, leading end 310 of first tool 301 has the shape of, for example, a sharp wedge so as to break and spread out an intermediate part of planar first face 111, while a leading end of second tool 302 has the shape of a wedge having a greater angle than leading end 310 of first tool 301. Bar 101 may be partly broken with first tool 301 first, and second tool 302 may be used next to spread out first face 111 of bar 101. Bar 101 is thus pressed multiple times by the tools of different shapes to be machined into the desired shape, whereby a load on each of the tools can be reduced. Accordingly, each of the tools can have an extended life.

Figure 8:
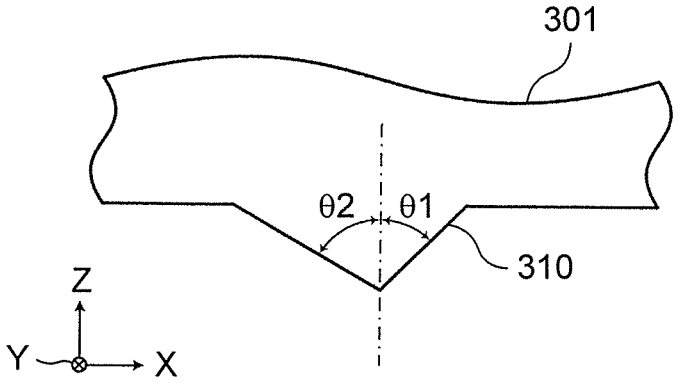
FIG. 8 is a side view illustrating another example of the leading end of the first tool according to the first exemplary embodiment.

Instead of having a symmetrical shape, leading end 310 of first tool 301 or the like may be such that, as shown in FIG. 8, angle θ1 of choice and angle θ2 of choice differ from each other to respectively indicate slopes of leading end 310 with respect to a pressing direction (Z-axis direction in the figure). In this way, hair raising effects of choice and skin irritation reductions of choice can be set. Moreover, the hair raising effects and the skin irritation reductions can be set in relation to shaving directions.

Second Exemplary Embodiment

A description is provided next of another exemplary embodiment of the method of producing the outer blade for the hair cutting device. It is to be noted that those (parts) having actions, functions, shapes, mechanisms, or structures that are similar to those in the first exemplary embodiment have the same reference marks, and their description may be omitted. The following description is centered on those different from the first exemplary embodiment, and description of the same contents as those of the first exemplary embodiment may be omitted.

Figure 9:
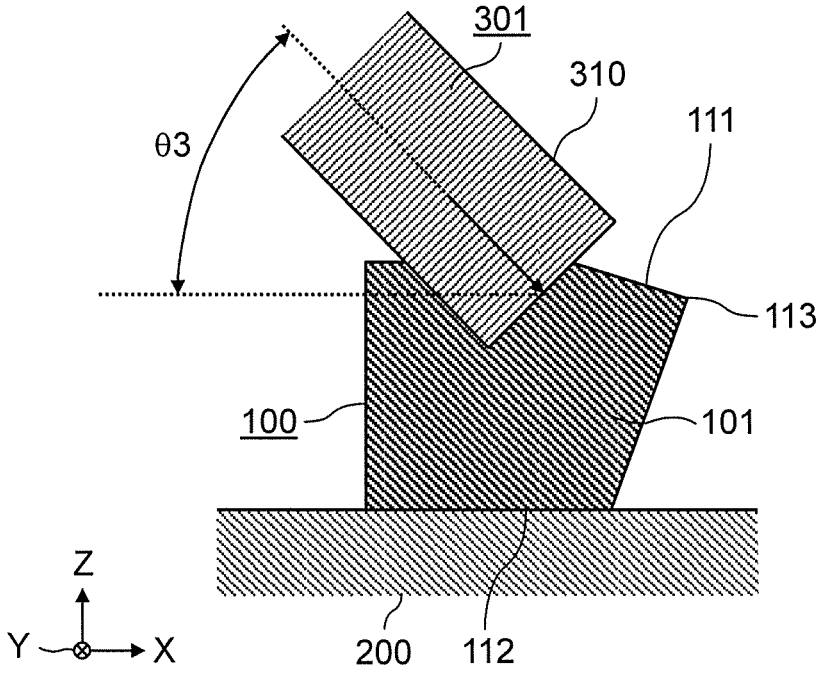
FIG. 9 is a sectional view illustrating a material, a base, and a first tool according to a second exemplary embodiment.

FIG. 9 is a sectional view illustrating material 100, base 200, and first tool 301 according to the second exemplary embodiment.

As shown in the figure, base 200 holds material 100 at its planer face and has no projecting strips 202 and the like that define grooves 201 as shown in FIGS. 2 and 4. Material 100 is held by friction between base 200 and material 100.

Next, leading end 310 of first tool 301 presses bar 101 obliquely (at angle θ3) to first face 111 as shown in FIG. 9. In the present exemplary embodiment, leading end 310 of first tool 301 has the shape of a rectangular stick and can cause only edge 113 on one side to project by applying force to bar 101 at angle θ3 to first face 111. In the present exemplary embodiment, when inserted obliquely to first face 111, a shape of leading end 310 of first tool 301 is such as to have a gradually increasing widthwise length (along an X-axis direction in the figure) in a direction away from first face 111.

Figure 10:
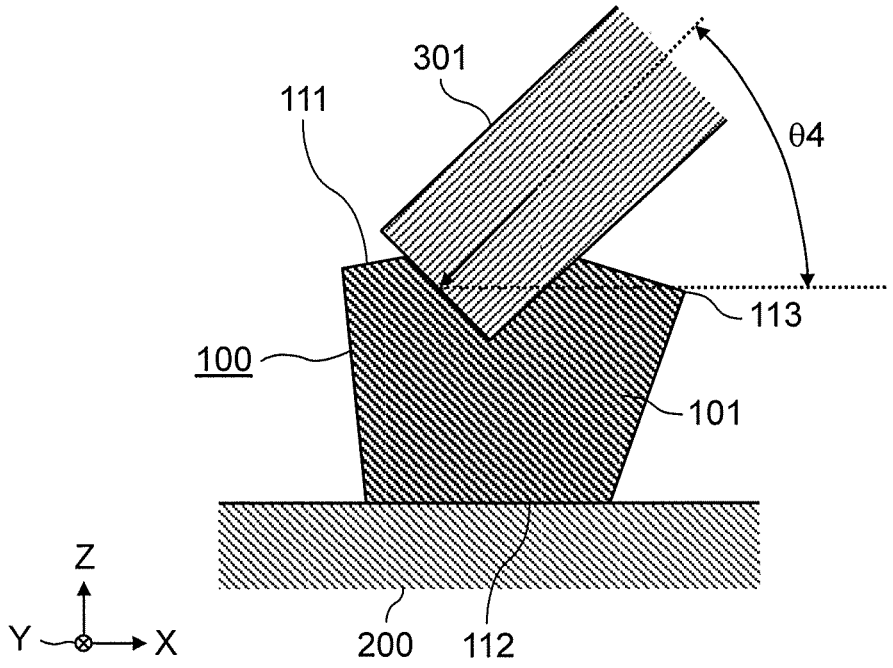
FIG. 10 is a sectional view illustrating the material, the base, and the first tool according to the second exemplary embodiment.

It is to be noted that as shown in FIG. 10, at least one of a pressing direction and the pressing angle may be changed to give a further press to the same position of bar 101.

In this way, two edges 113 of bar 101 each can have a projecting amount of choice and an angle of choice at which edge 113 projects toward an inner blade side.

Third Exemplary Embodiment

A description is provided next of yet another exemplary embodiment of the method of producing the outer blade for the hair cutting device. It is to be noted that those (parts) having actions, functions, shapes, mechanisms, or structures that are similar to those in the first and second exemplary embodiments have the same reference marks, and their description may be omitted. The following description is centered on those different from the first and second exemplary embodiments, and description of the same contents as those of the first and second exemplary embodiments may be omitted.

Figure 11:
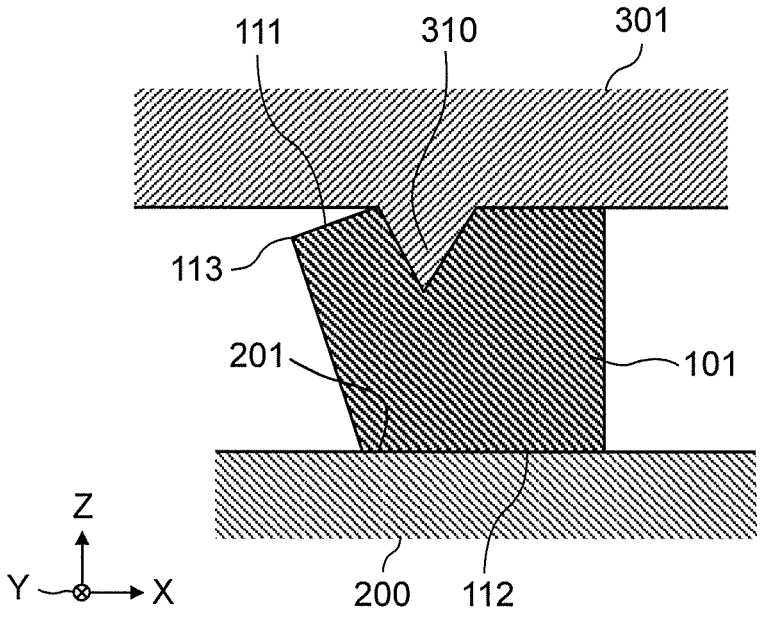
FIG. 11 is a sectional view illustrating a material, a base, and a first tool according to a third exemplary embodiment.
Figure 12:
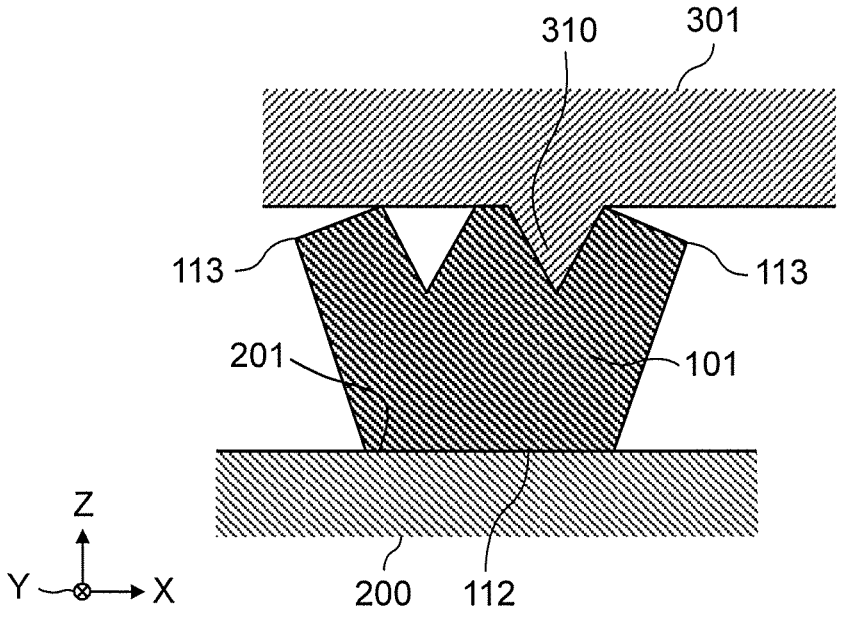
FIG. 12 is a sectional view illustrating the material, the base, and the first tool according to the third exemplary embodiment.

FIGS. 11 and 12 are sectional views illustrating material 100, base 200, and first tool 301 according to the third exemplary embodiment.

In the present exemplary embodiment, as shown in these figures, after first tool 301 presses bar 101 of material 100, which is placed on base 200, in a direction from first face 111 toward second face 112, respective positions of bar 101 and first tool 301 are shifted widthwise of bar 101 (along an X-axis direction in the figure) in relation to each other to allow first tool 301 to press first face 111 of bar 101.

The above producing method enables first face 111 of bar 101 to have a reduced area, namely, a reduced area of contact with a skin surface when an outer blade is used, so that irritation that might be caused by friction between the outer blade and skin can be reduced.

Figure 13:
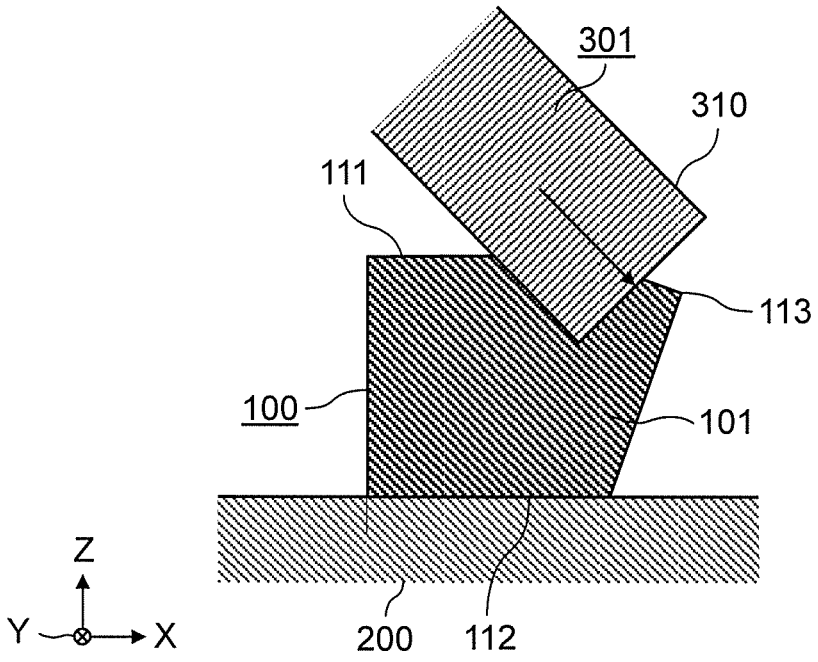
FIG. 13 is a sectional view illustrating a material, a base, and a first tool in a modification of the third exemplary embodiment.
Figure 14:
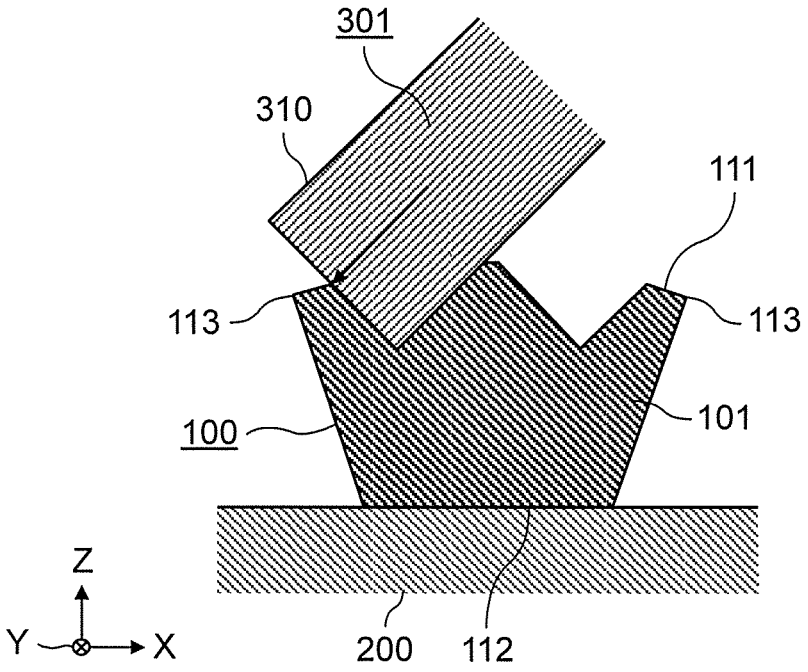
FIG. 14 is a sectional view illustrating the material, the base, and the first tool in the modification of the third exemplary embodiment.

It is to be noted that in order to allow edges 113 to project, different positions of bar 101 on a width of bar 101 may be pressed, as shown in FIGS. 13 and 14, through changing of at least one of a tool type, a pressing direction, and a pressing angle instead of shifting of the same tool.

Fourth Exemplary Embodiment

A description is provided next of still yet another exemplary embodiment of the method of producing the outer blade for the hair cutting device. It is to be noted that those (parts) having actions, functions, shapes, mechanisms, or structures that are similar to those in the first to third exemplary embodiments have the same reference marks, and their description may be omitted. The following description is centered on those different from the first to third exemplary embodiments, and description of the same contents as those of the first to third exemplary embodiments may be omitted.

Figure 15:
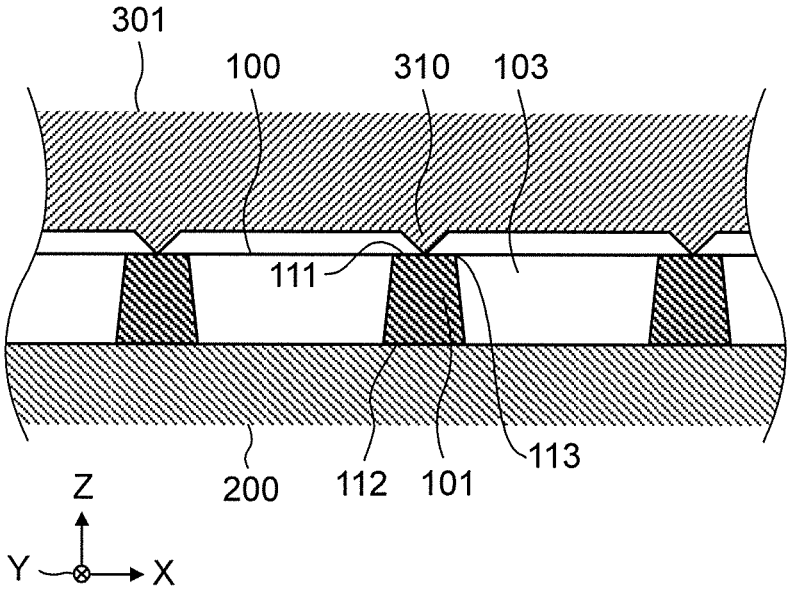
FIG. 15 is a sectional view illustrating a material, a base, and a first tool according to a fourth exemplary embodiment.

FIG. 15 is a sectional view illustrating material 100, base 200, and first tool 301 according to the fourth exemplary embodiment.

In the present exemplary embodiment, as shown in the figure, material 100 that undergoes pressing using first tool 301 is produced so that first face 111 of bar 101 has a smaller width than that of second face 112 of bar 101 along a width of bar 101 (along an X-axis direction in the figure). While a method of producing bar 101 having the above shape is not particularly limited, use of, for example, press working or etching from first face 111 only enables bar 101 to have a trapezoidal cross section that tapers toward a skin surface side.

The producing method described in any one of the first to third exemplary embodiments or the like is applied to material 100 that has bars 101 of trapezoidal cross section, whereby edge 113 formed projects more than a corresponding edge of second face 112 widthwise of bar 101 and projects toward second face 112 to be farther from an intermediate part of first face 111. Thus, a portion that is near first face 111 and is structurally weaker than a portion near second face 112 can selectively undergo plastic deformation, while the portion near second face 112 can keep its shape. Consequently, a second-face-side end that cuts hair by passing an inner blade (not shown) keeps its incisive shape and thus can maintain, as an edged tool, its cutting effect. Moreover, a reduced area of contact between an outer blade and a skin surface can be achieved, so that irritation that might be caused by friction between the outer blade and skin can be reduced.

Particularly, in cases where bar 101 has a trapezoidal cross section, the edge of second face 112 is acute, thus enabling enhanced hair cutting performance.

[Outer Blade for Hair Cutting Device]

Figure 16:
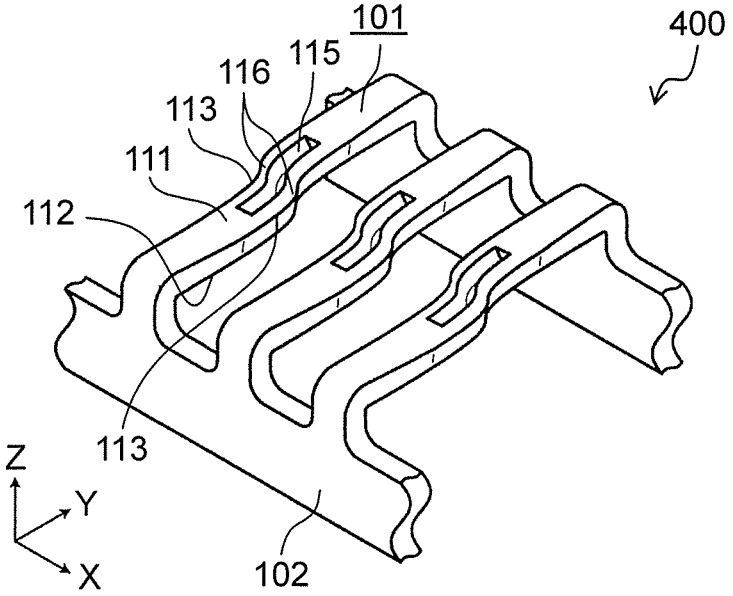
FIG. 16 is a perspective view of an outer blade for a hair cutting device.

FIG. 16 is a perspective view of outer blade 400 for a hair cutting device.

As shown in the figure, material 100 provided with projecting edges 113 has its frame 102 bent, for example, toward an inner blade side, thus becoming outer blade 400 for the hair cutting device including bars 101 that each have the shape of a rectangular stick and are arranged at predetermined intervals.

In the present exemplary embodiment, each of bars 101 is bent in the shape of a crank including two bends, and its part that has been pressed by leading end 310 of first tool 301 is a bent part of bar 101. Outer blade 400 also includes slopes 116 (first face 111 before bending) that gradually slope toward second face 112, each heading outward from an intermediate part of skin-contact-side first face 111 of bar 101 along a width of first face 111, and respective edges 113 of slopes 116. These edges 113 each project outwardly of second face 112. Recess 115 is an indentation formed by first tool 301 or the like. Edge 113 is disposed between at least two bends.

[Hair Cutting Device]

Figure 17:
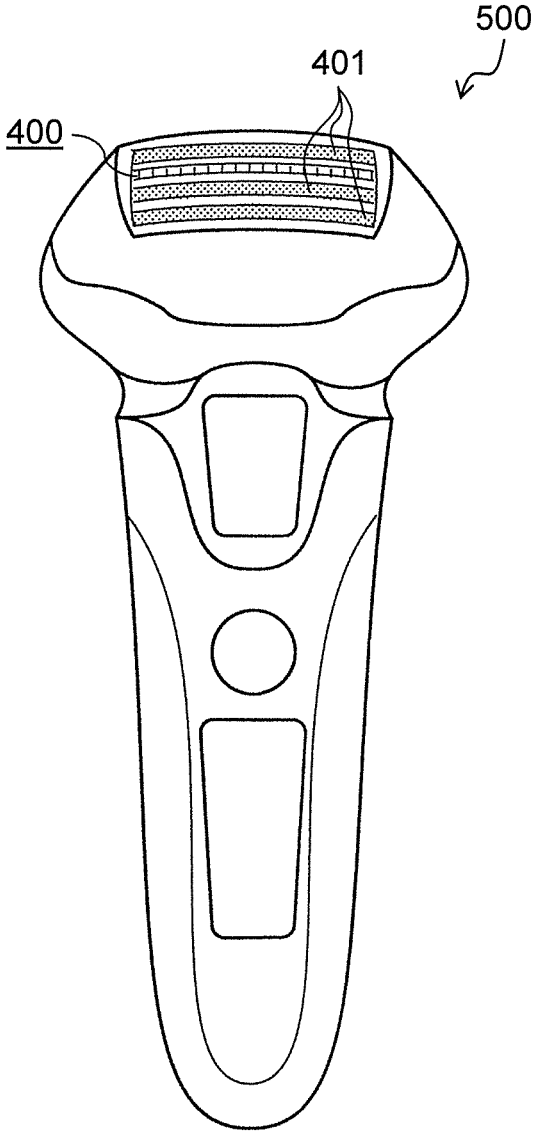
FIG. 17 is a front view of a hair cutting device.

FIG. 17 is a front view of hair cutting device 500.

As shown in this figure, hair cutting device 500 includes outer blade 400. In hair cutting device 500 of the present exemplary embodiment, outer blade 400 including projecting edges 113 is interposed among second outer blades 401 that are each thinner than outer blade 400.

With hair cutting device 500 including outer blade 400 that is produced by the method described in any one of the above-described first to fourth exemplary embodiments, edges 113 can catch and raise hair that grows along a skin surface when outer blade 400 is slid while being pressed against the skin surface, so that unshaved hair can be reduced. First face 111 of bar 101 of outer blade 400 makes hard contact with the skin surface and has the shape of a curved face including slopes 116, so that irritation that might be caused by friction between outer blade 400 and skin can be reduced.

Particularly, in cases where edges 113 are located to extend over a plurality of bends of bar 101, these edges 113 can effectively raise hair that grows in various directions, so that unshaved hair can be reduced even further.

[Others]

The above exemplary embodiments are not restrictive of the present disclosure. For example, other exemplary embodiments that are realized by combining the constituent elements of choice that are described in this description or excluding some of the constituent elements may also be exemplary embodiments of the present disclosure. Also modifications obtained by applying to the above exemplary embodiments various modifications that may be conceived of by those skilled in the art without departing from the spirit of the present disclosure, that is to say, meaning of the recitation in the claims are included in the present disclosure.

For example, while edge 113 is described as being a sharp part, edge 113 may be rounded off by undergoing, for example, press working, blasting, or surface polishing at least one of before and after the machining using first tool 301. Thus, irritation can be suppressed even in cases where edge 113 bites into skin.

Instead of being V-shaped, leading end 310 of first tool 301 may have its pointed end rounded off. In this way, stress that concentrates at leading end 310 can be eased, so that the tool can have an extended life.

While the above description is focused on one bar 101, the plurality of bars 101 may, at one time, undergo machining using, for example, first tool 301 that includes the plurality of leading ends 310.

Bars 101 may be arranged radially instead of being arranged in parallel relationship. A hair shaving method of the hair cutting device is not limited. Types of the method that can be given as examples include a reciprocating type, a rotating type, and a rotary type, and bar arrangement and a bar shape may be adopted accordingly for the outer blade.

Figure 18:
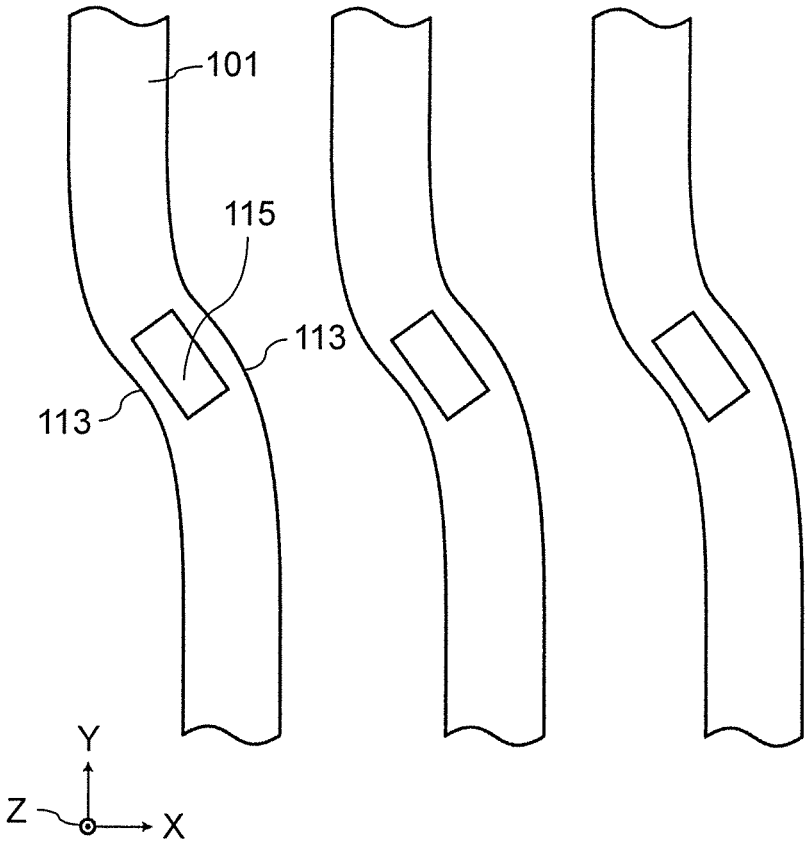
FIG. 18 is a plan view illustrating another example of the bar.

While edge 113 of bar 101 is disposed, in the description, between the two bends that are adjacent to each other to extend beyond these bends, edge 113 may be provided, as shown in FIG. 18, only between the bends that are adjacent to each other.

(Example of Method of Producing Outer Blade for Hair Cutting Device, Example of Outer Blade for Hair Cutting Device, and Example of Hair Cutting Device)

A method of producing the outer blade for the hair cutting device included in the present disclosure is a method of producing the outer blade for the hair cutting device from the material including the bars that each have a shape of the rectangular stick and are arranged at the predetermined intervals. In this method, the material is placed on the base. Next, the first tool having the leading end that has the gradually increasing width in the direction away from the material is used to press at least one part of each of the bars in the direction from the counter base-side first face of each of the bars toward the base-side second face of each of the bars. The edge of the first face of each of the bars is caused to project widthwise and to move toward the second face to be farther from the intermediate part of the first face.

When the hair cutting device is used, the outer blade obtained by this producing method has its edges disposed near a skin surface and thus can have an enhanced hair raising effect. Moreover, skin irritation can be reduced because the intermediate part of the first face comes into contact with the skin surface, while the edges project in respective positions where the skin surface is difficult to contact.

When the material is placed on the base, the bars may partly be fitted, along a thickness direction extending from the first face to the second face, in the respective grooves that are provided in the base and are spaced correspondingly to the respective bars.

As such, the portion near the second face, particularly the second-face-side end that contributes to hair cutting, can keep its incisive shape even in cases where stress is caused on the bar by the pressing of the first tool.

The part of the bar that has been pressed by the first tool may be pressed by the second tool having the leading end that differs in shape from the leading end of the first tool.

In this way, the bar can be plastically deformed in a gradual manner over multiple times and thus can avoid getting cracks and the like. Moreover, a load on the tool can be reduced, so that the tool can have an extended life.

The first tool may press the bar obliquely to the first face.

In this way, a projecting position of choice can be determined for the edge.

The bar may be pressed further with the pressing angle changed.

In this way, the outer blade having the edges that respectively assume different projecting positions can be produced. For example, the outer blade can have a hair raising effect that varies depending on a curved direction.

After the bar has been pressed by the use of the first tool, the respective positions of the bar and the first tool may be shifted widthwise of the bar in relation to each other to allow the first tool to further press the bar.

In this way, the first face of the bar can have a relatively reduced area, and the outer blade that can thus be produced has reduced frictional resistance as a result of a reduced area of contact with a skin surface and thus can be slid on the skin surface with less irritation.

The bar that undergoes pressing using the first tool may have the first face that has the smaller width than that of the base-side second face along the width of the bar.

In this way, a second face side can be made structurally stronger than a first face side, and with stress that is caused by the first tool's press concentrating at the first face side, the second face side can keep its shape. Accordingly, the second-face-side end that contributes to hair cutting can keep its incisive shape.

The outer blade for the hair cutting device also included in the present disclosure includes the bars that each have the shape of the rectangular stick and are arranged at the predetermined intervals. The outer blade also includes the slope that gradually slopes toward the inner-blade-side second face of each of the bars, heading outward from the intermediate part of the skin-contact-side first face of each of the bars along the width of the first face, and the edge of the slope. This edge projects outwardly of the second face.

As such, an enhanced hair raising effect can be achieved along with reduced skin irritation.

The bar may have a cranked shape and may include two or more bends, and the edge may be disposed between the bends that are adjacent to each other.

Thus, an enhanced hair raising effect can be exerted even on hair that does not grow in the same direction.

The present disclosure can be used for production of an outer blade that is used in a hair cutting device for shaving hair such as a beard and head hair, and also can be used for an outer blade.

What is claimed is:

1. A method of producing an outer blade for a hair cutting device, the method comprising:

placing a material on a base, the material including a plurality of bars arranged at predetermined intervals; and pressing, using a first tool having a plurality of leading ends each corresponding to a respective one of the bars and each of the leading ends having a gradually increasing width in a direction away from the material, at least one part of each of the bars in a direction from a counter base-side first face of each of the bars toward a base-side second face of each of the bars to cause an edge of the first face of each of the bars to project widthwise and to move toward the second face to be farther from an intermediate part of the first face.

2. The method according to claim 1, wherein, when the material is placed on the base, the bars are partly fitted, along a thickness direction extending from the first face to the second face, in respective grooves that are provided in the base and are spaced correspondingly to respective ones of the bars.

3. The method according to claim 1, further comprising pressing, using a second tool having a leading end that differs in shape from the leading end of the first tool, the at least one part of the bar that has been pressed by the first tool.

4. The method according to claim 1, wherein pressing, using the first tool, comprises pressing the leading ends of the first tool on respective ones of the bars obliquely to the first face.

5. The method according to claim 4, further comprising:

changing an angle of pressing of the first tool, the angle being relative to the first face; and pressing the leading ends of the first tool on respective ones of the bars at the changed angle.

6. The method according to claim 1, wherein pressing, using the first tool, includes pressing the at least one part of each of the bars using the leading ends of the first tool, and the method further comprises:

after pressing the bars using the first tool, shifting positions of each of the bars and the first tool relative to each other in a widthwise direction of the bars; and pressing a different portion of each of the bars using the leading ends of the first tool.

7. The method according to claim 1, further comprising reducing a width of the first face widthwise of each of the bars as compared with a corresponding width of the second face before each of the bars is pressed using the first tool.

* * * * *